US005936525A

United States Patent [19]

Leyden et al.

[11] Patent Number: 5,936,525

[45] Date of Patent: Aug. 10, 1999

[54] SENSOR FOR MONITORING AN ARTICLE

[75] Inventors: Roger J. Leyden, Willow Springs; Michael A. Parent, Palatine, both of Ill.

[73] Assignee: Se-Kure Controls, Inc., Franklin Park, Ill.

[21] Appl. No.: 08/899,504

[22] Filed: Jul. 24, 1997

[51] Int. Cl.[6] ..... G08B 13/22

[52] U.S. Cl. ..... 340/568.2; 340/572.1; 340/652

[58] Field of Search ..... 340/568, 572, 340/652, 568.2, 572.1

[56] References Cited

U.S. PATENT DOCUMENTS

| | | | |
|---|---|---|---|
| 1,559,380 | 10/1925 | Roe | 174/117 A |
| 3,072,500 | 1/1963 | Berlinhof | 428/164 |
| 3,634,845 | 1/1972 | Colman | 340/508 |
| 3,932,857 | 1/1976 | Way et al. | 340/572 |
| 4,000,488 | 12/1976 | Ephraim | 340/572 |
| 4,455,464 | 6/1984 | Leyden | 200/61.93 |
| 4,587,517 | 5/1986 | Engstrom et al. | 340/542 |
| 4,654,640 | 3/1987 | Carll et al. | 340/568 |
| 5,172,098 | 12/1992 | Leyden et al. | 340/568 |
| 5,541,578 | 7/1996 | Lussey | 340/571 |
| 5,574,430 | 11/1996 | Ott et al. | 340/568 |
| 5,644,295 | 7/1997 | Connolly et al. | 340/568 |

*Primary Examiner*—Glen R. Swann, III
*Attorney, Agent, or Firm*—Wood, Phillips, VanSanten, Clark & Mortimer

[57] ABSTRACT

A sensor has a substrate with a first surface having a substantial area, a conductive trace defining a conductive path on the substrate between first and second locations, and an adhesive on the first surface for adhering the sensor to an object to be monitored in an operative state. A weakening is provided in the substrate to cause separation/tearing of the substrate in a predetermined fashion as an incident of a force being applied to the substrate with the sensor in the operative state tending to peel the sensor off of the object to be monitored. The conductive trace is arranged on the substrate so that as the substrate separates/tears in the predetermined fashion, the conductive path defined by the conductor trace is interrupted.

21 Claims, 3 Drawing Sheets

FIG. 4
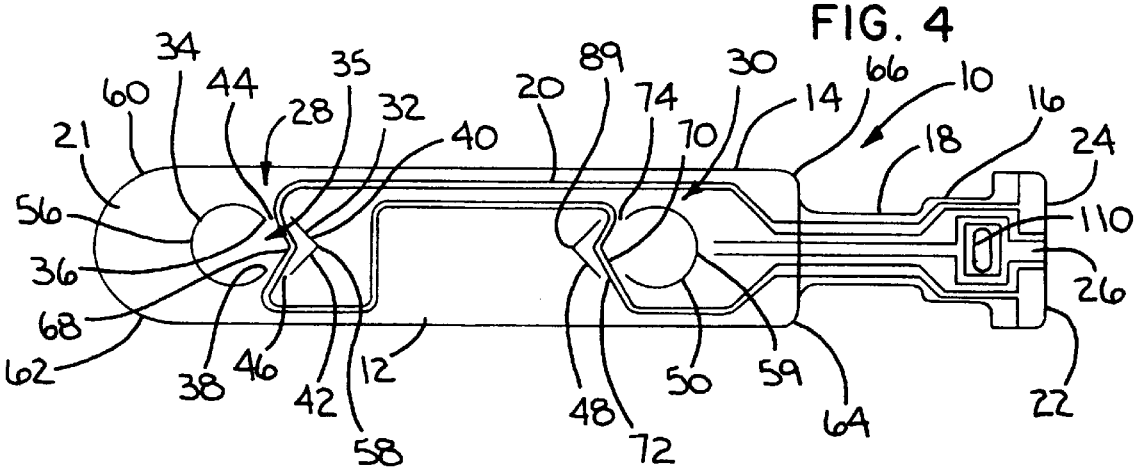
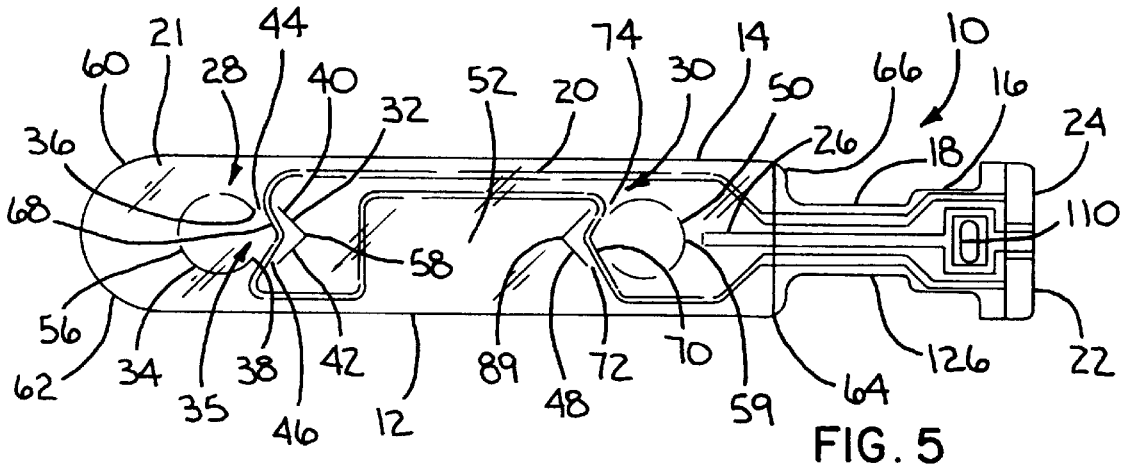
FIG. 5
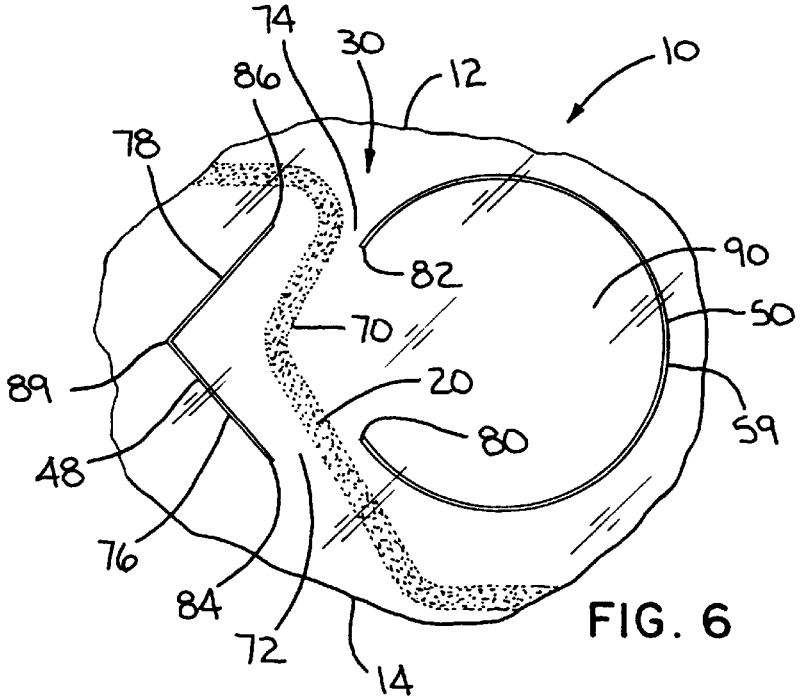
FIG. 6

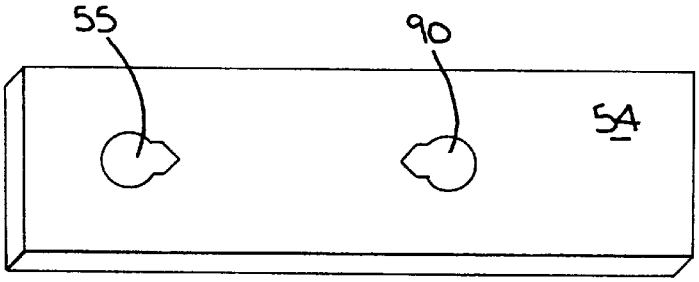
FIG. 7
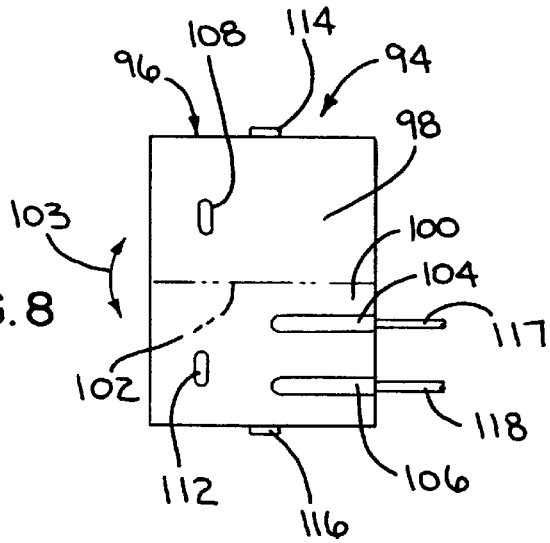
FIG. 8
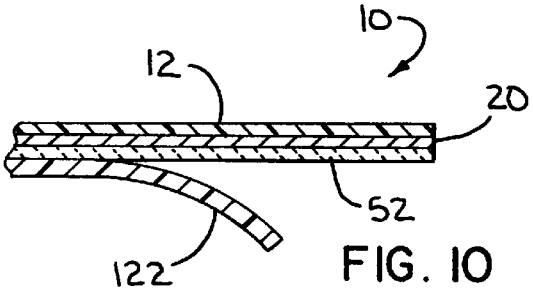
FIG. 10
FIG. 9
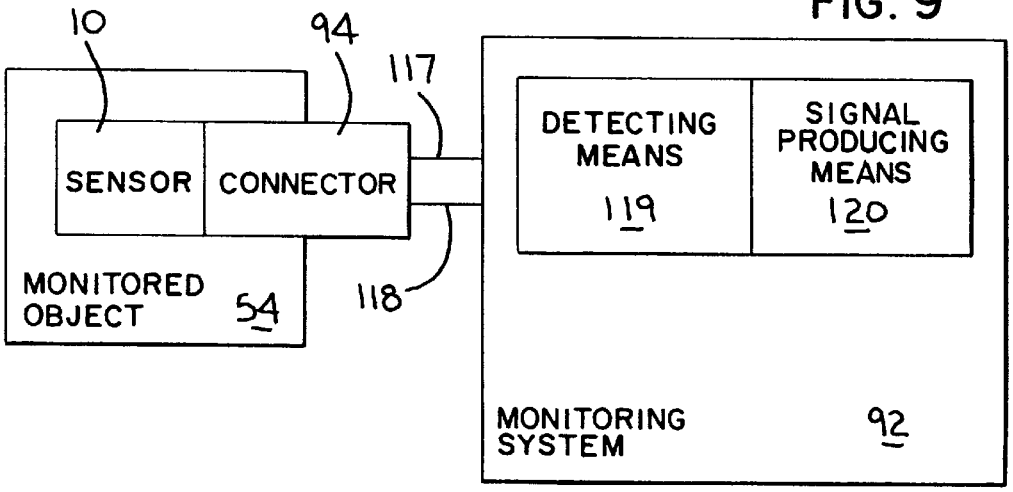

SENSOR FOR MONITORING AN ARTICLE

BACKGROUND OF THE INVENTION

1. Field of the Invention

This invention relates to sensors of the type that can be adhered to an article to be monitored and which change state as an incident of being removed from the article.

2. Background Art

For decades, purveyors of articles who display the articles for consumer inspection have sought effective systems for preventing unauthorized removal of these articles from the display area. Designers of these types of systems have contended with many objectives which are often competing with each other. Most significantly, it is important that the system effectively deter theft. Cost is always a significant consideration in the design of such systems. It is also important that the systems be user friendly, i.e., that they can be easily and consistently activated. The more complicated the systems become to operate, the more likely it is that employees will improperly set the systems up or altogether avoid activation thereof. At the same time, it is desirable that these systems be relatively unobtrusive. Large, electronic sensors on a relatively small article may detract from the visual appeal to the potential consumer. On a small article, a relatively large profile sensor may also inhibit effective inspection of the article.

One sensor design that meets a number of the above objectives is that which uses a flexible substrate as the main body of the sensor. A conductive trace is provided on the substrate, with an adhesive applied to the substrate to facilitate adherence of the sensor to an article to be monitored. The tenacity and the location of the adhesive may be selected to cause part of the conductive trace to remain on the substrate and part on the article as the substrate is peeled away from an article to which it is adhered. The sensor is electrically connected to a monitoring system which produces a detectable signal as an incident of detecting that the conductive path defined by the trace has been interrupted.

One version of this sensor applies adhesive at only selected locations on the substrate and over the trace. When the substrate is peeled off, the adhesive is designed to maintain a part of the trace bonded to the article. The unbonded portion of the trace separates with the substrate to cause interruption of the conductive path defined by the trace.

It is also known to cause part of the trace to be bonded more securely to the substrate than with the adhesive layer over part thereof, and another part to be more securely held to the adhesive layer than to the substrate. This produces the same effect upon the substrate being peeled from the article to which the sensor is attached.

In both of the above versions, the substrate is designed to remain substantially intact as the substrate is peeled from the article that is monitored.

SUMMARY OF THE INVENTION

In one form of the invention, a sensor is provided for attachment to an article to be monitored. The sensor has a substrate with a first surface having a substantial area, a conductive trace defining a conductive path on the substrate between first and second locations, and an adhesive on the first surface for adhering the sensor to an object to be monitored in an operative state. A weakening is provided in the substrate to cause separating/tearing of the substrate in a predetermined fashion as an incident of a force being applied to the substrate with the sensor in the operative state tending to peel the sensor off of the object to be monitored. The conductive trace is arranged on the substrate so that as the substrate separates/tears in the predetermined fashion, the conductive path defined by the conductor trace is interrupted.

The adhesive may be applied over the conductive trace.

In one form, the weakening includes one of a U-shaped cut and a V-shaped cut at least partially through the substrate.

The substrate may have a connecting portion to be operatively engaged with a monitoring system for the sensor, with the first and second locations being on the connecting portion.

The weakening may include first and second spaced weakening cuts at least partially through the substrate.

In one form, the substrate has a frangible portion between the first and second weakening cuts so that the substrate separates/tears along the first and second cuts as an incident of the force being applied to the substrate tending to peel the substrate off an object to be monitored and tears the frangible portion between the first and second cuts.

The first and second cuts may be configured and spaced so that with the substrate separated/torn along the first and second cuts and the frangible portion of the substrate torn, a discrete portion of the substrate separates from the remainder of the substrate. The adhesive may be provided on the discrete portion of the substrate so that the discrete portion of the substrate remains adhered to the object to be monitored, with the remainder of the substrate separated from the object.

The conductive trace and the conductive path may extend across the discrete portion of the substrate so that the conductive path is interrupted as an incident of the discrete portion of the substrate separating from the remainder of the substrate.

The conductive trace may extend across the frangible portion of the substrate without crossing either of the first and second weakening cuts.

The substrate may be made from a polyester sheet.

A dielectric coating may be provided on the substrate at the connecting portion.

The one of a U-shaped cut and a V-shaped cut may open in one direction. A second, cut, having one of a V shape and a U shape, may be provided at least partially through the substrate opening oppositely to the one direction.

The sensor may be provided in combination with an object to be monitored to which the sensor is adhered in the operative state.

The sensor may further be provided in combination with a monitoring system electrically connected to the conductive trace at the first and second locations. The monitoring system may have structure for detecting when the conductive path is interrupted and for producing a signal as an incident of the detecting structure detecting that the conductive path is interrupted.

The invention may also include in combination with the above a structure for receiving the signal and, as an incident thereof, causing production of a separate signal that can be audibly or visually detected.

The substrate may be made partially or wholly from a flexible sheet.

In another form, the invention contemplates a sensor for attachment to an article to be monitored, with the sensor including a substrate having a first surface with a substantial area, a conductive element on the first surface, and an adhesive on the first surface for adhering the sensor to an object to be monitored in an operative state. A weakening is provided in the substrate to cause tearing of the substrate in a predetermined fashion such that a discrete portion of the substrate separates from the remainder of the substrate as an incident of a force being applied to the substrate with the sensor in the operative state tending to peel the sensor off an object to be monitored. The conductive element has a first state with the sensor in the operative state and a second state with the discrete portion of the substrate separated from the remainder of the substrate. With this arrangement, a monitoring system can be used to detect the first and second states of the conductive element and to produce a signal indicative of the fact that the conductive element has changed from the first state into the second state.

BRIEF DESCRIPTION OF THE DRAWINGS

FIG. 4 is a bottom view of the substrate in FIG. 3 with a conductive trace thereon;

FIG. 5 is a view as in FIG. 2 with a release layer removed;

FIG. 6 is an enlarged, fragmentary, plan view of the inventive sensor showing part of the conductive trace and a weakening in the substrate that causes tearing thereof in a predetermined fashion if the substrate is peeled from an object being monitored;

FIG. 7 is a perspective view of an article from which the inventive sensor was removed from an operative state and showing discrete portions of the sensor which remain intact on the object;

FIG. 8 is a plan view of a connector for mechanically and electrically joining the sensor to a monitoring system;

FIG. 9 is a schematic representation of a monitoring system operatively connected to the inventive sensor in an operative state on an article to be monitored; and FIG. 10 is an enlarged, fragmentary, cross-sectional view of the inventive sensor taken along line 10—10 of FIG. 2.

DETAILED DESCRIPTION OF THE DRAWINGS

Figure 1:
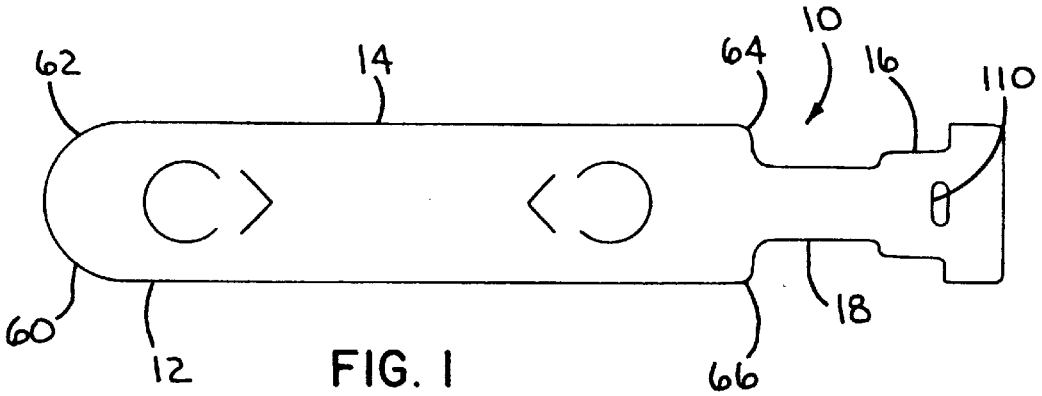
FIG. 1 is a plan view of a sensor, for attachment to an article to be monitored, according to the present invention.
Figure 2:
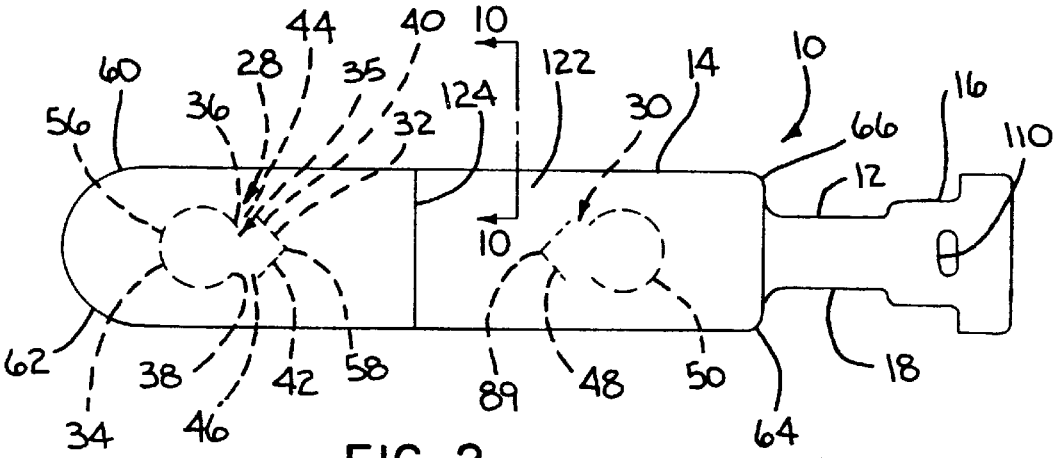
FIG. 2 is a bottom view of the sensor in FIG. 1.
Figure 3:
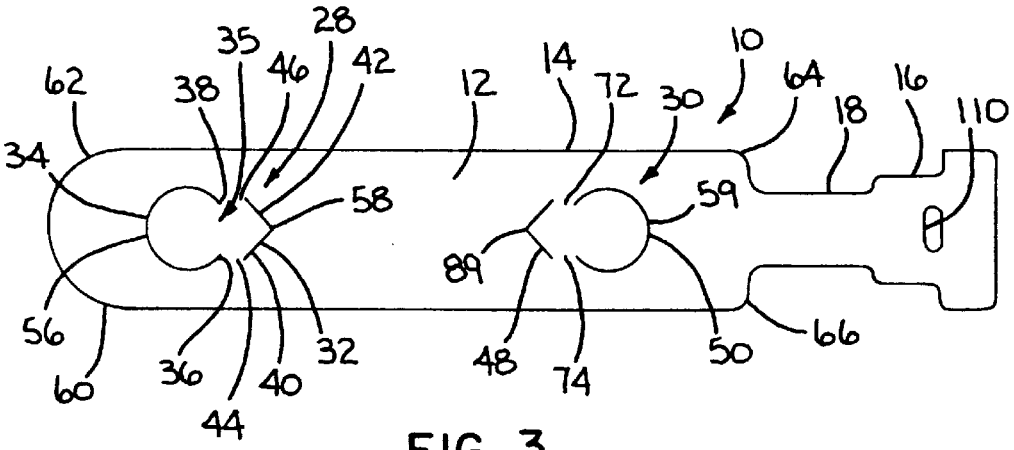
FIG. 3 is a plan view of a flexible substrate on the sensor in FIGS. 1 and 2.

A sensor, according to the present invention, is shown at 10 in FIGS. 1 through 10. The sensor 10 consists of a substrate layer 12 made of flexible material. A suitable material for this substrate layer is polyester, which may be on the order of 0.005 inch thick. A suitable polyester material is available commercially and sold under the trademark MYLAR™. The substrate layer 12 is defined by a generally rectangular body 14 and a connecting portion 16, with the body 14 and connecting portion 16 being joined by a neck 18.

A conductive trace 20 is conventionally applied to the underside 21 of the substrate layer 12. The conductive trace 20 is formed in a circuitous path to define a continuous conductive path between first and second locations 22, 24 on the connecting portion 16 of the substrate layer 12. A grounding trace portion 26 extends from the connecting portion 16, between the first and second locations 22, 24, across the neck 18 to an intermediate location on the body 14.

According to the invention, the substrate layer 12 has a weakening, in this case at two spaced locations 28, 30. The weakening at the location 28 consists of a continuous V-shaped cut 32 extending into the substrate layer 12. In a preferred form, the cut extends fully through the substrate layer 12. However, the invention contemplates that the cut 32 may extend only partially through the substrate layer 12. The cut 32, as all other weakening cuts described hereinbelow, may be defined alternatively by serrations which extend either partially or fully through the substrate layer 12. The V shape of the cut 32 opens towards a circular cut 34, which extends through approximately 290°, producing a U shape with an opening at 35 between spaced ends 36, 38 which are spaced equidistantly from two legs 40, 42 defining the cut 32. The cut 34 extends fully through the substrate 12, but may also be formed only partially through the substrate 12. A frangible portion 44 resides between the end 36 of the cut 34 and the leg 40 of the cut 32. A similar frangible portion 46 resides between the end 38 of the cut 34 and the leg 42 of the cut 32.

The weakening at the location 30 has a similar, but reversed, arrangement of cuts. In this case, a V-shaped cut 48, corresponding to the cut 32, opens oppositely to the cut 32 and towards a circular, U-shaped cut 50, with the cuts 48, 50 having the same relative position as the cuts 32, 34.

An adhesive layer 52 is applied over the underside 21 of the substrate layer 12 over substantially the entire surface of the body 14. Through the adhesive layer 52, the sensor 10 is maintained in an operative state on an object 54 to be monitored. Two-sided adhesive tapes are commercially available that are suitable for this purpose. One suitable tape is Scotch-brand "transfer tape" #9690 with a thickness of 0.005 inch. The adhesive layer 52 is tenacious enough that with the sensor 10 in the operative state, any attempt to peel the sensor 10 from the monitored object 54 will cause the substrate layer 12 to separate/tear in a predetermined fashion at the weakening. The weakening at the exemplary location 28 is designed so that a peeling of the substrate layer 12 adhered to the object 54 causes the substrate layer 12 to separate at the cuts 32, 34 and to rupture the frangible portions 44, 46 therebetween, thereby causing a discrete portion 55 of the substrate layer 12 to become separated from the remainder of the substrate layer 12. The depth of the cuts 32, 34 and the tenacity of the adhesive are selected so that the substrate layer 12 will not inadvertently separate along the cuts 32, 34 in normal use, yet will separate/tear in a predetermined fashion when someone tampers with the sensor 10.

The most anticipated strategy for tampering involves peeling the sensor 10 off of the object 54 by grasping the neck 18 and connecting portions 16 of the substrate layer 12 and exerting an upward and right-to-left force thereon in FIGS. 1–5. However, the invention is directed to preventing breach of security by a left-to-right peeling. Under this left-to-right peeling action, separation of the substrate layer 12 is initiated at the edge 56 of the U-shaped cut 34. The separation continues over the full extent of the cut 34 up to and through the frangible portions 44, 46 to the cut 32, progressing therethrough to the apex 58 of the cut 32 whereupon the discrete portion 55 becomes fully separated from the remainder of the substrate layer 12. The cuts 32, 34 and 48, 50 are reversed so that the edge 59 of the U-shaped cut 50 will initiate separation of the substrate layer 12 as a result of a right-to-left peeling of the sensor 10 in FIGS. 1–6.

All four corners 60, 62, 64, 66 of the body 14 are rounded to deter tampering as is facilitated by a sharp corner. This configuration addresses tampering undertaken by peeling from left to right which might be attempted by a thief to avoid the more obvious right-to-left peeling facilitated by the accessible and graspable neck 18 and connecting portion 16 of the substrate layer 12.

According to the invention, the sensor 10 is designed so that as it is peeled from the monitored object 54, separation/tearing, in the predetermined fashion described above, causes the conductive trace 20 to be broken to thereby interrupt the conductive path between the first and second locations 22, 24. In this embodiment, one leg 68 of the conductive trace 20 is located between the cuts 32, 34 and extends across the frangible portions 44, 46. Another leg 70 of the conductive trace 20 extends between the cuts 48, 50 across like, frangible portions 72, 74 therebetween. When the frangible portions 44, 46 rupture, the conductive trace leg 68 severs. Similarly, when the frangible portions 72, 74 rupture, the trace leg 70 likewise breaks. This situation can be seen most clearly in FIG. 6.

Right-to-left peeling causes separation of the substrate layer 12 initially at the edge 59. The separation continues along the cut 50 towards the legs 76, 78 of the cut 48. The separation/tearing eventually reaches the ends 80, 82 of the cut 50 and continues across the frangible portions 72, 74 to the ends 84, 86 of the cut legs 76, 78. The separation continues along the cut 48 to the apex 89, whereupon a discrete portion 90 of the substrate layer 12 becomes separated from the remainder of the substrate layer 12.

The fracturing of the conductive trace 20 is detected through a monitoring system 92. The monitoring system 92 includes a connector 94 (FIGS. 8 and 9) which both electrically and mechanically connects the sensor 10 to the monitoring system 92. More particularly, the connector 94 has a housing 96 with parts 98, 100 which are joined at a hinge 102. The hinge 102 allows the housing parts 98, 100 to be pivoted, as indicated by the double-headed arrow 103, relative to each other between an open position in FIG. 8, and a closed position, wherein conductors 104, 106 on the connector 94 are electrically connected to the trace 20, on each at the locations 22, 24. A projecting stud 108 on the connector part 98 projects through a cut-out 110 in the substrate layer 12 and into a seat 112 defined on the other connector part 100. Cooperating latch elements 114, 116 cooperate to maintain the connector 94 in the closed position, wherein the connecting portion 16 of the substrate layer 12 is mechanically locked in a position wherein the conductive trace 20 is in electrical contact with the conductors 104, 106. The conductors 104, 106 are operatively connected to the monitoring system 92 through cables 117, 118.

A specific, suitable design of the monitoring system 92 can be arrived at by one skilled in the art. Many commercially available systems exist which would perform adequately. Generally, the monitoring system 92 has detecting means 119 for detecting two different states for the sensor 10, one with the conductive trace 20 defining a continuous conductive path between the first and second locations 22, 24, and a second state wherein the conductive trace 20 is interrupted between the first and second locations 22, 24. In response to detecting the second state, the detecting means 119 produces a signal to a signal producing means 120, which generates a signal that can be sensed, i.e., audibly or visually.

To facilitate mounting of the sensor 10, a release layer 122 is provided over the adhesive layer 52. By producing a cut 124 at the mid-portion thereof, peeling of the release layer 122 is facilitated to expose the adhesive layer 52 for application thereof to the object 54.

A dielectric layer 126 can be applied over the substrate layer 20 at the connecting portion 16 and neck 18 thereof to prevent accidental shorting between the first and second locations (or intentional shorting thereof by a potential thief).

To assemble the sensor 10, the connector 94 can be pre-attached. In this state, the user need only peel off the release layer 122 and press the sensor 10 into the operative position. Alternatively, the sensor 10 can be pre-applied, after which the connector 94 is attached thereto.

The foregoing disclosure of specific embodiments is intended to be illustrative of the broad concepts comprehended by the invention.

We claim:

1. A sensor for attachment to an article to be monitored, said sensor comprising:

a substrate having a first surface;

a conductive trace defining a conductive path on the substrate between first and second locations; and an adhesive on the first surface for adhering the sensor to an object to be monitored in an operative state, there being a weakening on the substrate to cause separation/tearing of the substrate in a pre-determined fashion as an incident of a force being applied to the substrate with the sensor in the operative state tending to peel the sensor off of an object to be monitored, the conductive trace being arranged on the substrate so that as the substrate separates/tears in the predetermined fashion the conductive path defined by the conductive trace is interrupted.

2. The sensor according to claim 1 wherein the adhesive is applied on the first surface over the conductive trace.

3. The sensor according to claim 1 wherein the weakening comprises one of a U-shaped cut and a V-shaped cut at least partially through the substrate.

4. The sensor according to claim 3 wherein the substrate has a connecting portion to be operatively engaged with a monitoring system for the sensor and the first and second locations are on the connecting portion.

5. The sensor according to claim 4 wherein there is a dielectric coating on the substrate at the connecting portion to prevent shorting between the first and second locations.

6. The sensor according to claim 3 wherein the one of a U-shaped cut and a V-shaped cut opens in one direction and the weakening comprises a second cut that is one of U-shaped and V-shaped at least partially through the substrate and opening oppositely to the one direction.

7. The sensor according to claim 1 wherein the weakening comprises first and second spaced weakening cuts at least partially through the substrate.

8. The sensor according to claim 7 wherein the substrate has a frangible portion between the first and second weakening cuts, the substrate separating/tearing along the first and second cuts as an incident of the force being applied to the substrate tending to peel the substrate off an object to be monitored and tearing the frangible portion between the first and second cuts.

9. The sensor according to claim 8 wherein the first and second cuts are configured and spaced so that with the substrate separated/torn along the first and second cuts and the frangible portion of the substrate torn, a discrete portion of the substrate separates from the remainder of the substrate, the adhesive being on the discrete portion of the substrate so that the discrete portion of the substrate remains adhered to an object to be monitored with the remainder of the substrate separated from an object to be monitored.

10. The sensor according to claim 9 wherein the conductive trace and the conductive path extend across the discrete portion of the substrate so that the conductive path is interrupted as an incident of the discrete portion of the substrate separating from the remainder of the substrate.

11. The sensor according to claim 10 wherein the conductive trace extends across the frangible portion of the substrate without crossing either of the first and second weakening cuts.

12. The sensor according to claim 1 in combination with an object to be monitored to which the sensor is adhered in the operative state.

13. The sensor according to claim 1 wherein the substrate comprises a polyester sheet.

14. The sensor according to claim 1 in combination with a monitoring system electrically connected to the conductive trace at the first and second locations and comprising means for detecting when the conductive path is interrupted and for producing a signal as an incident of the detector means detecting that the conductive path is interrupted.

15. The sensor according to claim 14 in combination with a means for receiving the signal and as an incident thereof causing production of a signal that can be one of audibly or visually detected.

16. The sensor according to claim 1 wherein the substrate comprises a flexible sheet.

17. A sensor for attachment to an article to be monitored, said sensor comprising:

a substrate having a first surface;

a conductive element on the first surface; and an adhesive on the first surface for adhering the sensor to an object to be monitored in an operative state;

there being a weakening in the substrate to cause separation/tearing of the substrate in a predetermined fashion such that a discrete portion of the substrate separates from the remainder of the substrate as an incident of a force being applied to the substrate with the sensor in the operative state tending to peel the sensor off an object to monitored, the conductive element having a first state with the sensor in the operative state and a second state with the discrete portion of the substrate separated from the remainder of the substrate, whereby a monitoring system can be used to detect the first and second states of the conductive element and produce a signal indicative of the fact that the conductive element has changed from the first state into the second state.

18. The sensor according to claim 17 in combination with a monitoring system having means to detect the state of the conductive element and to produce a signal indicative of the fact that the conductive element has changed from the first state to the second state.

19. The sensor according to claim 17 in combination with an object to which the sensor is adhered in the operative state.

20. The sensor according to claim 17 wherein the substrate comprises a flexible sheet.

21. The sensor according to claim 20 wherein the flexible sheet comprises polyester.

* * * * *